US005697226A

United States Patent [19]

Marchesi

[11] Patent Number: 5,697,226

[45] Date of Patent: Dec. 16, 1997

[54] SELF-CONTAINED AIR-CONDITIONER OF THE WALL-MOUNTED TYPE

[75] Inventor: Fernando Marchesi, Gualtieri, Italy

[73] Assignee: Elettroplastica Elettrodomestici S.r.L., Cellatica, Italy

[21] Appl. No.: 681,209

[22] Filed: Jul. 23, 1996

[30] Foreign Application Priority Data

Jul. 27, 1995 [IT] Italy ..... RE95A0043

[51] Int. Cl.[6] ..... F25D 23/12

[52] U.S. Cl. ..... 62/263; 62/407

[58] Field of Search ..... 62/262, 263, 404, 62/407, 410, 412, 427

[56] References Cited

U.S. PATENT DOCUMENTS

| | | | |
|---|---|---|---|
| 2,644,321 | 7/1953 | Borgerd | 62/263 |
| 3,123,987 | 3/1964 | Moore | 62/263 |
| 3,938,348 | 2/1976 | Rickert | 62/262 |
| 4,544,023 | 10/1985 | Marciniak | 62/263 |
| 5,388,426 | 2/1995 | Wada et al. | 62/263 |

FOREIGN PATENT DOCUMENTS

| | | | |
|---|---|---|---|
| 6-034153 | 2/1994 | Japan | 62/263 |

*Primary Examiner*—John M. Sollecito
*Attorney, Agent, or Firm*—Browdy and Neimark

[57] ABSTRACT

Internal air-conditioning unit to be installed at the top of a wall, in which suction of the air introduced in the room is performed in the top part of the casing, the evaporation set being provided in the vicinity of the rear wall thereof. The invention solves the problem of introducing into the room fresh external air, without having to use other external air-driving means.

17 Claims, 2 Drawing Sheets

A
E
1
2
3
4
5
6
7
8
9
10
11
12
13
14
15
16
17
20
21
22

SELF-CONTAINED AIR-CONDITIONER OF THE WALL-MOUNTED TYPE

BACKGROUND OF THE INVENTION

The present invention relates to the sector of self-contained wall-mounted air-conditioners and in particular to that part of the air-conditioning plant which is installed inside the building, the conventional external part known as the "motor/condensation" unit remaining unvaried.

In the sector it is known of air-conditioning plants in which there is a physical separation between the so-called "internal unit", which may also be multiple, and the so-called "external unit" which has installed inside it the cold-generating compressor, the condensing set and a motor-driven fan designed to produce forced ventilation through the condensing set.

In these known plants, the so-called "internal unit" and the external unit are connected to one other via a dual duct (usually consisting of copper piping) for conveying the cold-generating fluid, associated with a multiple electric cable, and a flexible pipe for discharging the condensate produced inside the internal unit.

In such known systems, the internal unit comprises a containment casing, usually of parallelepiped shape, comprising an evaporating set, a motor-driven fan, and an electric and/or electronic control board, operation generally being performed by means of infra-red ray remote control.

In such a known internal unit, the air to be processed generally enters the front/upper part and the processed air is expelled from the bottom part; said unit is in fact intended for installation at the top of a wall, in the vicinity of the ceiling.

Said known internal unit, moreover, does not allow the room air to be changed, said air in practice being completely recirculated inside the unit.

In these known systems, in fact, in order to change the room air, separate motorized air-driving means must be installed, so as to cause an excess pressure or reduced pressure, inducing the change-over.

Moreover, frequently the change-over is obtained, also for the sake of simplicity of the driving means used and the maintenance operations, without filtering of the air introduced, with all of the negative consequences which adversely affect the hygiene of the environment.

The object of the present invention is to provide an internal air-conditioning unit for rooms which allows and facilitates changing of the room air, without having to make use of separate driving means.

A further object is to ensure that the external air introduced into the room is subjected to filtration, without further complicating the normal procedures for construction and maintenance of the equipment.

A final, but no less important object is to ensure that the noise emission in the room due to operation of the equipment is reduced so as to be even lower than the normal emission levels.

SUMMARY OF THE INVENTION

These objects are obtained, as expressed by the meaning of the claims, by positioning inside the internal unit the evaporation set in the bottom part of the machine and consequently allowing the introduction of air in the side facing the wall.

BRIEF DESCRIPTION OF THE DRAWINGS

The invention will be understood more clearly from the description of an example of embodiment provided hereinbelow with the aid of two illustrative plates.

In said plates.

DESCRIPTION OF THE PREFERRED EMBODIMENTS

Figure 1:
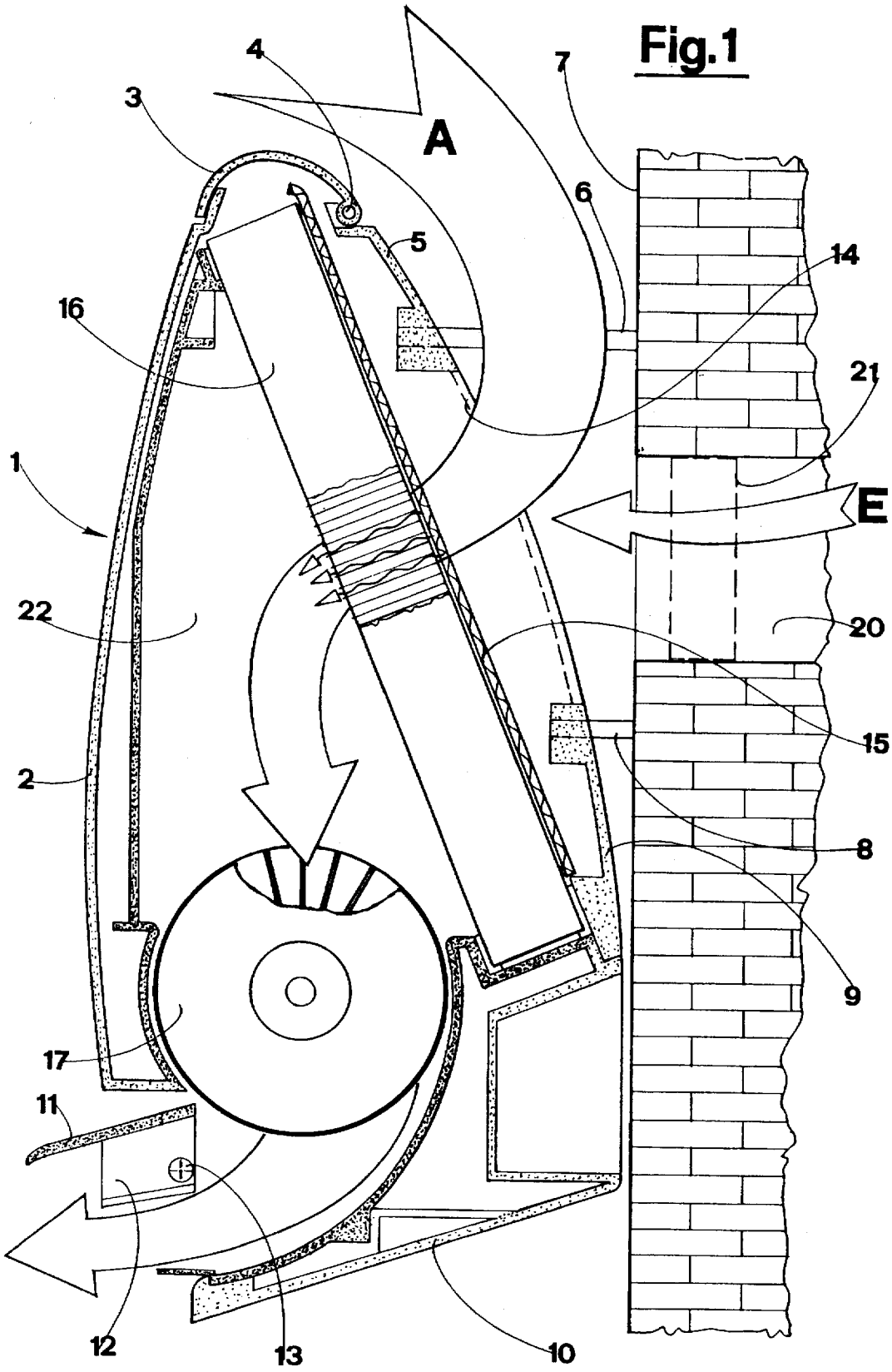
FIG. 1 shows a schematic sectional view, along a vertical transverse plane, of an air-conditioner constructed according to the invention.
Figure 2:
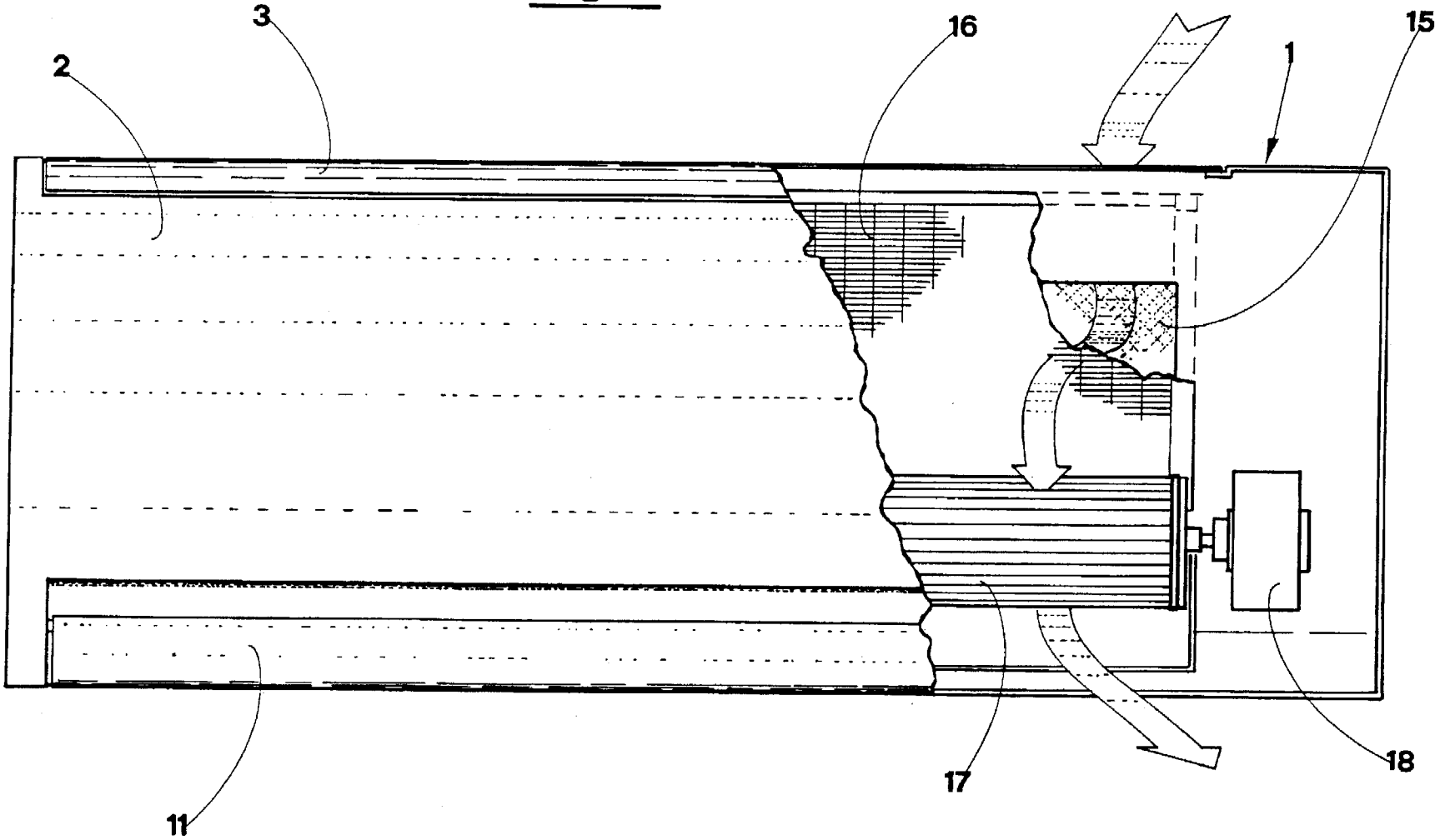
FIG. 2 shows a partially sectioned front view thereof.

With reference to these figures, 1 denotes in its entirety the wall-mounted air-conditioner; 2 the front part of the casing thereof; 3 an upper cover which can be pivoted about the hinge 4.

5 denotes an upper stiffening ribbing along the entire length, having fixed to it an upper bracket 6 for fixing to the wall 7.

8 denotes a similar lower wall-fixing bracket anchored to the rigid longitudinal ribbing 9.

10 denotes a bottom closing wall of the air-conditioner 1.

11 denotes a movable deflector supported by ribs 12 fixed to the rotating axis 13 which is designed to be of the motorized type in accordance with known devices not illustrated herein for the sake of simplicity.

14 denotes a grill for sucking back in the room air A, located between the upper ribbing 9 and the lower ribbing 9; 15 denotes a filtering panel supported by suitable lateral-slide guides and designed to be extractable at the top through the opening provided by the pivoting cover 3. As shown in FIG. 1, the grille 14 is inclined to the wall 7 at an angle, creating a space therebetween. The casing 1 is closely adjacent the wall 7 at its lower end, but separated from the wall above.

16 denotes an evaporating set connected to known cold-generating fluid pipes not shown in the Figure; 17 denotes a known tangential fan driven by the coaxial electric motor 18.

Said fan 17 produces a reduced pressure inside the collection chamber 22, expelling the processed air externally via the deflector 11.

20 denotes an opening communicating with the external environment; 21 denotes a flow-regulating shutter which may be remote-controlled.

The apparatus is completed by known accessory devices such as an electronic control and command or remote-control board, electric protection devices, condensate collection basin with associated drainage pipes, etc., which are not illustrated here for the sake of simplicity and greater clarity of the description.

Operation is as follows:

When the air-conditioner is activated, the deflector 11 is positioned in the open position, as illustrated in FIG. 1, and the tangential fan 17 is also made to rotate, creating a reduced pressure inside the collection chamber 22.

A suction flow therefore occurs through the grill 14, into which both room air (indicated by the arrow A) and external air (indicated by the arrow E) flow, it being possible to modify the ratio of the external air / room air throughput, by regulating the shutter 21.

It is thus possible to achieve the aforementioned primary object of allowing the introduction of external air which causes changing of the room air, resulting in a slight excess pressure inside the room.

The object of filtering the external air introduced via the filtering panel 15 is also achieved, without complicating the mechanical structure of the machine and the operations for maintenance of the air-conditioner which are performed by means of normal cleaning of the filtering panel 15 alone.

Finally, the further object of reducing the noise input levels inside the room is also achieved since said inputs, which arise mainly from the opening of the grill 14.

Although shown in the example illustrated with a flow-regulating shutter 21 located on the exterior access duct, the invention may also be installed, in a variant, with a motor-driven fan in place of the shutter.

Both positioning of the shutter (7) and driving of the fan may be operated by means of a known remote-control device.

A single remote-control device may also operate both the air-conditioner (1) and the shutter (7), thus resulting in the desired recirculation ratio.

What is claimed:

1. An internal unit of a self-contained air-conditioner including a support structure constituting means to be mounted on a wall, comprising a containment casing, an evaporating set, a motor-driven fan, and a dual duct for conveying cold-generating fluid, wherein inside the internal unit the evaporating set (16) is provided in a region of a rear part of the containment casing facing the wall, and wherein an air suction grill (14) is located in the region of the rear part of the containment casing.

2. The internal unit according to claim 1, wherein the wall includes a duct communicating with the exterior and the internal unit is installed adjacent the duct (20).

3. The internal unit as claimed in claim 2 above, wherein air regulating or driving means (21) are installed on the duct (20) communicating with the exterior.

4. The internal unit as claimed in claim 3, wherein a filtering panel (15) is provided between the suction grill (14) and the evaporating set (16).

5. The internal unit as claimed in claim 4 above, wherein the filtering panel (15) is of the type extractable from the top after opening of an upper cover (3).

6. The internal unit as claimed in claim 1 installed in association with a duct (20) communicating with the exterior.

7. The internal unit as claimed in claim 6 above, wherein air regulating or driving means (21) are installed on the duct (20) communicating with the exterior.

8. The internal unit as claimed in claim 1, wherein a filtering panel (15) is provided between the suction grill (14) and the evaporating set (16).

9. The internal unit as claimed in claim 8 above, wherein the filtering panel (15) is of the type extractable from the top after opening of an upper cover (3).

10. The internal unit as claimed in claim 1, wherein a filtering panel (15) is provided between the suction grill (14) and the evaporating set (16).

11. The internal unit as claimed in claim 10 above, wherein the filtering panel (15) is of the type extractable from the top after opening of an upper cover (3).

12. The internal unit as claimed in claim 2, wherein a filtering panel (15) is provided between the suction grill (14) and the evaporating set (16).

13. The internal unit as claimed in claim 12 above, wherein the filtering panel (15) is of the type extractable from the top after opening of an upper cover (3).

14. The internal unit as claimed in claim 6, wherein a filtering panel (15) is provided between the suction grill (14) and the evaporating set (16).

15. The internal unit as claimed in claim 14 above, wherein the filtering panel (15) is of the type extractable from the top after opening of an upper cover (3).

16. The internal unit according to claim 1, wherein the means to be mounted on the wall includes means for the region of the rear part of the containment casing to be inclined at an angle to the wall.

17. The internal unit according to claim 1, wherein the means to be mounted on the wall includes means for the containment casing to be adjacent the wall at a lower end of the casing.

* * * * *